US010442101B2

(12) United States Patent
Kim

(10) Patent No.: US 10,442,101 B2
(45) Date of Patent: Oct. 15, 2019

(54) METHOD FOR ALIGNING SUBSTRATE AND APPARATUS FOR CUTTING SUBSTRATE USING THE SAME

(71) Applicant: Samsung Display Co., Ltd., Yongin-si, Gyeonggi-do (KR)

(72) Inventor: Ik Kyoung Kim, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 241 days.

(21) Appl. No.: 15/221,976

(22) Filed: Jul. 28, 2016

(65) Prior Publication Data

US 2016/0332317 A1 Nov. 17, 2016

Related U.S. Application Data

(62) Division of application No. 14/057,260, filed on Oct. 18, 2013.

(30) Foreign Application Priority Data

May 3, 2013 (KR) ..... 10-2013-0050109

(51) Int. Cl.

| | |
|---|---|
| ***B26D 7/01*** | (2006.01) |
| ***B26D 7/20*** | (2006.01) |
| ***B26F 1/38*** | (2006.01) |

(52) U.S. Cl.

CPC ..... *B26D 7/015* (2013.01); *B26D 7/018* (2013.01); *B26D 7/20* (2013.01); *B26F 1/3813* (2013.01); *Y10T 83/7593* (2015.04)

(58) Field of Classification Search

CPC ..... B26D 7/018; B26D 7/20; B26F 1/3813

See application file for complete search history.

(56) References Cited

U.S. PATENT DOCUMENTS

| | | | | | |
|---|---|---|---|---|---|
| 3,210,069 | A | | 10/1965 | Holtz | |
| 3,880,029 | A | * | 4/1975 | Bonaddio | C03B 33/027 83/451 |
| 4,477,064 | A | * | 10/1984 | DiGiulio | B25B 5/08 269/231 |
| 4,479,435 | A | * | 10/1984 | Takeuchi | B25B 11/005 101/389.1 |
| 4,772,000 | A | * | 9/1988 | Aubert | B25B 1/2473 269/137 |

(Continued)

FOREIGN PATENT DOCUMENTS

| | | | |
|---|---|---|---|
| KR | 2002-0090523 | A | 12/2002 |
| KR | 10-2006-0083270 | A | 7/2006 |
| KR | 10-2008-0055176 | A | 6/2008 |

*Primary Examiner* — Kenneth E Peterson
*Assistant Examiner* — Liang Dong
(74) *Attorney, Agent, or Firm* — H.C. Park & Associates, PLC

(57) ABSTRACT

A method for aligning a substrate and an apparatus for cutting a substrate using the same are provided. In one aspect of the present invention, an apparatus for aligning a substrate comprises a stage on which the substrate is seated and reference pins provided to project from an upper surface of the stage. Each reference pin has a substrate support surface which supports one side of the substrate. An upper end of the substrate support surface is formed so as to project further toward the substrate than a lower end thereof.

9 Claims, 9 Drawing Sheets

(56) References Cited

U.S. PATENT DOCUMENTS

| | | | | |
|---|---|---|---|---|
| 4,795,518 | A * | 1/1989 | Meinel | H01L 21/6838 156/285 |
| D322,259 | S | 12/1991 | Quandt | |
| 5,573,230 | A * | 11/1996 | Lambertini | B25B 5/08 269/235 |
| 6,530,733 | B2 | 3/2003 | Klein et al. | |
| 6,682,288 | B2 | 1/2004 | Klein et al. | |
| 6,821,912 | B2 | 11/2004 | Klein et al. | |
| 7,405,810 | B2 | 7/2008 | Hennus et al. | |
| 7,469,886 | B2 * | 12/2008 | Shen | B25B 11/005 269/21 |
| 8,067,578 | B2 | 11/2011 | Goldberg et al. | |
| 8,388,853 | B2 | 3/2013 | Koelmel et al. | |
| 2012/0008144 | A1 | 1/2012 | Kim et al. | |
| 2012/0073417 | A1 * | 3/2012 | Ujiie | B26D 7/018 83/24 |

* cited by examiner

METHOD FOR ALIGNING SUBSTRATE AND APPARATUS FOR CUTTING SUBSTRATE USING THE SAME

CLAIM OF PRIORITY

This application is filed pursuant to 35 U.S.C. § 121 as a Divisional Application of Applicant's patent application Ser. No. 14/057,260 filed in the U.S. Patent & Trademark Office on 18 Oct. 2013, which claims priority to and the benefit of Korean Patent Application No. 10-2013-0050109, filed on May 3, 2013 in the Korean Intellectual Property Office, claims all benefits accruing there from under 35 U.S.C. § 120, and makes reference to, incorporates the same herein.

BACKGROUND OF THE INVENTION

Field of the Invention

The present invention relates to an apparatus for aligning a substrate and an apparatus for cutting a substrate using the same.

Description of the Related Art

According to the trend of lightweight and thin-filming of not only home display devices, such as TVs and monitors, but also portable display devices, such as notebook computers, cellular phones and PMPs, various flat display devices have been widely used. Flat display devices, which have currently been produced or developed, include a liquid crystal display (LCD), an electro luminescent display (LED), a flat emission display (FED), a plasma display panel (PDP), and an organic light emitting display (OLED).

SUMMARY OF THE INVENTION

A procedure for producing a flat display device includes various kinds of processes which are sequentially performed on a substrate. In order for the respective processes that are sequentially performed so as to be accurately performed on the substrate, it is essential to align the position of the substrate in the respective processes.

In particular, flat display devices are produced through a process of cutting and separating a mother substrate, which is made of glass, silicon, or ceramic, into unit substrates, and in order to cut the mother substrate accurately and stably, it is necessary that the mother substrate be in a preferable alignment state.

One subject to be solved by the present invention is to provide an apparatus for aligning a substrate, which can maintain a more accurate and stable alignment state, and an apparatus for cutting a substrate using the same.

Additional advantages, subjects, and features of the invention will be set forth in part in the description which follows, and in part will become apparent to those having ordinary skill in the art upon examination of the following or may be learned from practice of the invention.

In one aspect of the present invention, there is provided an apparatus for aligning a substrate comprising a stage on which the substrate is seated and reference pins provided to project from an upper surface of the stage, wherein the reference pin has a substrate support surface which supports one side of the substrate, and an upper end of which is formed so as to project further toward the substrate than a lower end thereof.

In another aspect of the present invention, there is provided an apparatus for cutting a substrate comprising a stage on which the substrate is seated, reference pins which are formed so as to project from one side of the stage to support one side of the substrate and an upper end of which is formed so as to project further toward the substrate than a lower end thereof, and a cutting portion provided on an upper portion of the stage to cut the substrate.

According to embodiments of the present invention, at least the following advantages can be achieved.

That is, by the shape of the reference pins, each of which has the upper end that is formed so as to project to the substrate side as compared with the lower end thereof, the substrate can be stably aligned in a state where the reference pins preferentially support the upper end of one side of the substrate. Furthermore, a crack, which may occur on the reference pin due to the repeated use thereof, can be guided to the upper side thereof that supports the upper end of the one side of the substrate, and thus the substrate can be stably aligned, even after the crack occurs.

The advantages according to the present invention are not limited to the contents as exemplified above, but other various advantages are described in the specification of the present invention.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
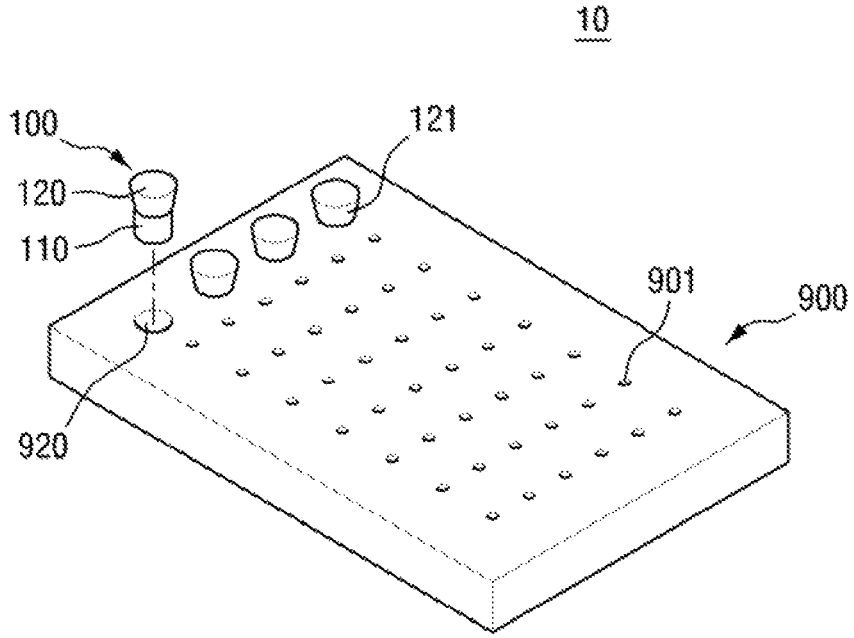
FIG. 1 is a schematic perspective view of an apparatus for aligning a substrate according to a first embodiment of the present invention.

The aspects and features of the present invention and methods for achieving the aspects and features will be apparent by referring to the embodiments to be described in detail with reference to the accompanying drawings. However, the present invention is not limited to the embodiments disclosed hereinafter, but can be implemented in diverse forms. The matters defined in the description, such as the detailed construction and elements, are nothing but specific details provided to assist those of ordinary skill in the art in a comprehensive understanding of the invention, and the present invention is only defined within the scope of the appended claims.

The term "on" that is used to designate that an element is on another element or located on a different layer or a layer includes both the case where an element is located directly on another element or a layer and the case where an element is located on another element via another layer or still another element. In the entire description of the present invention, the same drawing reference numerals are used for the same elements across various figures.

Although the terms "first", "second", and so forth are used to describe diverse constituent elements, such constituent elements are not limited by the terms. The terms are used only to discriminate a constituent element from other constituent elements. Accordingly, in the following description, a first constituent element may be a second constituent element.

Hereinafter, preferred embodiments of the present invention will be described in detail with reference to the accompanying drawings.

Figure 2:
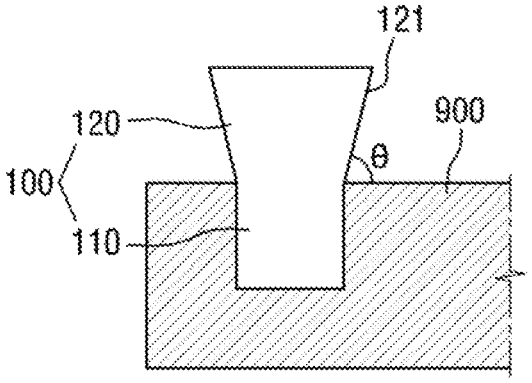
FIG. 2 is an enlarged view illustrating the installation state of a reference pin according to the first embodiment of the present invention.

FIG. 1 is a schematic perspective view of an apparatus for aligning a substrate according to a first embodiment of the present invention, and FIG. 2 is an enlarged view illustrating the installation state of a reference pin according to the first embodiment of the present invention.

As illustrated in FIG. 1, an apparatus 10 for aligning a substrate according to this embodiment includes a stage 900 and reference pins 100.

The stage 900 is a flat plate on which a substrate is seated, and may include an adsorption unit that fixes the substrate. The adsorption unit includes a plurality of suction holes formed at predetermined intervals on an area where the substrate is seated, and suction flow paths 902 formed on an inner side of the stage to communicate with the plurality of suction holes 901. The suction flow paths may be connected to a vacuum pump (not illustrated) to provide vacuum pressure to the suction holes.

FIG. 1 illustrates the stage 900 having the suction holes 901 as an example of a constituent element that fixes the substrate. However, various configurations for fixing the substrate, such as an electrostatic chuck provided on the area where the substrate is seated, may be adopted.

The stage 900 may include a plurality of reference pin installation grooves 920 formed at predetermined intervals along one side of the area where the suction holes 901 formed thereon are seated.

Furthermore, the reference pin 100 according to this embodiment may include an insertion end 110 formed on a lower portion thereof and a projection end 120 formed on an upper portion thereof.

The insertion end 110 may be inserted into the reference pin installation groove 920 that is provided on the stage 900, and may be formed so as to correspond to the shape of the reference pin installation groove 920. The shape of the insertion end 110 may be variously determined in consideration of replacement easiness and substrate supporting force of the reference pin 100. In this embodiment, as an example, the cylindrical insertion end 110 is provided, and corresponding to this, the reference pin installation groove 920 is also in a cylindrical shape.

The projection end 120 may be formed so as to extend from the insertion end 110, and may be provided on an upper portion of the insertion end 110. In the case where the reference pin 100 is installed on the stage 900 through insertion of the insertion end 110 into the reference pin installation groove 920, the projection end 120 may be provided so as to project from the stage 900. In order for the reference pin 100 to stably support the one side of the substrate, it is preferable that the projection end 120 be formed so as to project further than the height of the substrate.

As illustrated in FIGS. 1 and 2, the projection end 120 is formed so that an upper end portion of a surface 121 (hereinafter referred to as a "substrate support surface"), which is directed to the other side of the stage 900 among side surfaces of the projection end 120 projects further toward the other side of the stage 900 than a lower end portion thereof. The direction of the other side of the stage 900 based on the reference pin 100 may be a direction in which the substrate that is supported by the reference pin 100 is positioned.

As described above, the shape of the projection end 120 is such as to make an upper end of one side of the substrate preferentially come into contact with the substrate support surface 121 when the projection end 120 supports the one side of the substrate. As an example of the shape, in this embodiment, the projection end 120 includes a shape of an inverse circular truncated cone.

The side surface of the inverse circular truncated cone forms an inversely inclined surface. The inversely inclined surface may connect the lower end portion and the upper end portion of the substrate support surface. Since the inversely inclined surface comes into contact with an upper portion of the one side of the substrate and provides a support force for supporting the substrate on a lower side that is substantially perpendicular to the inversely inclined surface, the substrate can be stably supported and aligned on the stage 900.

On the other hand, it is preferable that the inversely inclined surface be formed so that an acute angle formed between the inversely inclined surface and the stage 900 is equal to or larger than 85 degrees. If the acute angle is set to be smaller than 85 degrees, the upper end of the one side of the substrate may be damaged while the substrate reaches and is supported by the inversely inclined surface.

The projection end 120 is a constituent element that comes into contact with the substrate, and may be formed of a material, which has a superior impact resistance so as to prevent the damage of the substrate, and which has a superior anti-wear property so as to continuously maintain shape, even in the repeated substrate alignment process, for example, PEEK of engineering plastic.

Figure 3:
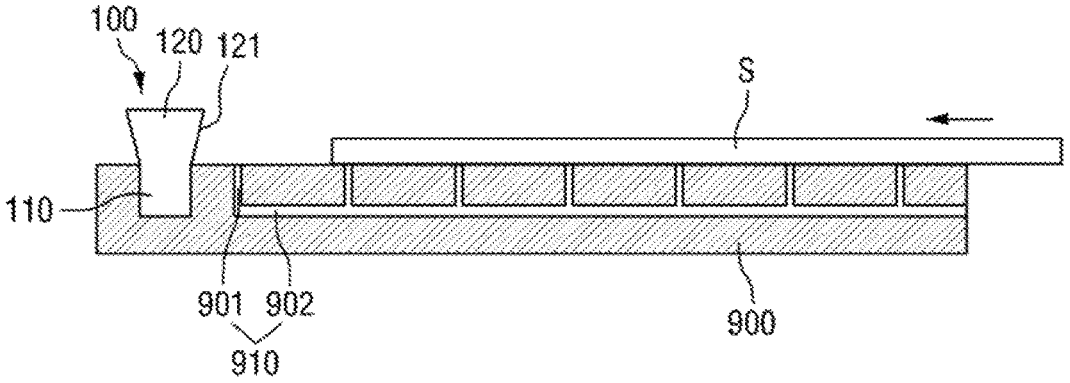
FIGS. 3 and 4 are views illustrating a substrate alignment process that is performed by an apparatus for aligning a substrate according to the first embodiment of the present invention.
Figure 4:
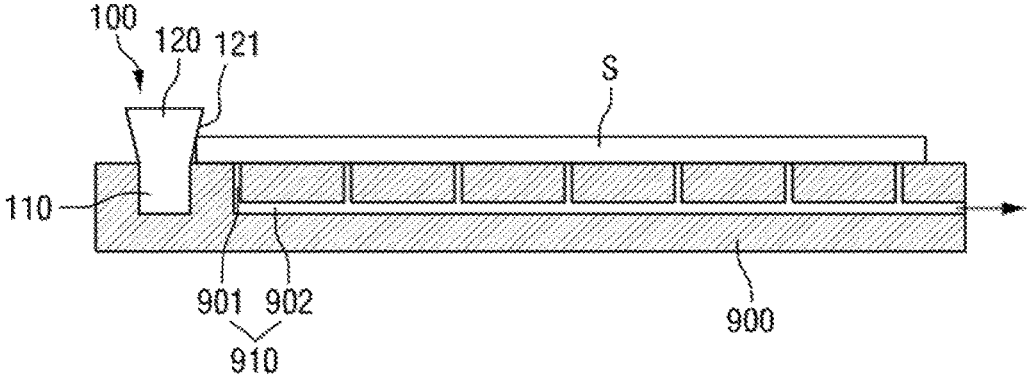

FIGS. 3 and 4 are views illustrating a substrate alignment process that is performed by an apparatus for aligning a substrate according to the first embodiment of the present invention.

The substrate S may be loaded on the stage 900 in a state where the substrate S is spaced apart from the reference pins 100 by a predetermined distance.

Thereafter, as illustrated in FIG. 3, the substrate S on the stage 900 may move toward the reference pins 100. Although not illustrated, a push unit (not shown) which pushes the substrate S toward the reference pins 100 may be provided on the other side of the substrate S so as to move the substrate S toward the reference pins 100.

As illustrated in FIG. 4, the substrate S moves until the one side of the substrate S comes into contact with and is supported by the substrate support surface 121 of each reference pin 100, and the alignment position of the substrate S may be determined by the reference pins 100 arranged in a line on the stage 900.

The one side of the substrate S comes into contact with the substrate support surface 121, and since the substrate support surface 121 is inversely inclined, the one side of the substrate S may be supported by the reference pins 100 as corners of the upper portion thereof comes into contact with the substrate support surface 121.

After the substrate S is supported by the reference pins 100 and is seated on the alignment position, in order to fix the substrate S onto the stage 900, vacuum exhaust may be performed through suction holes 901 and suction flow paths 902 which are provided in the stage 900. As a result, since vacuum pressure is formed between the substrate S and the stage 900, the substrate S is tightly fixed to the stage 900, and then processes which are performed with respect to the substrate S can be stably performed.

Figure 5:
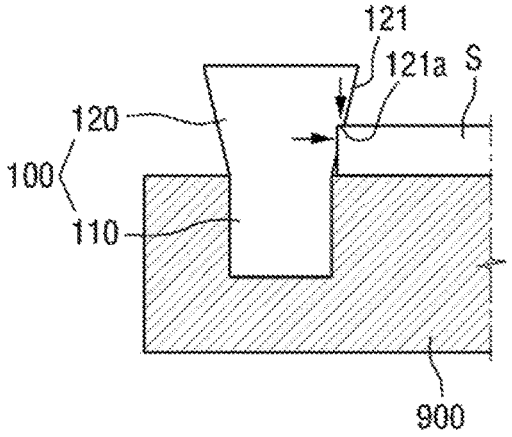
FIG. 5 is a view illustrating a substrate alignment state of a reference pin, the substrate support surface of which is worn out due to repeated substrate alignment.

FIG. 5 is a view illustrating a substrate alignment state of a reference pin, the substrate support surface of which is worn out due to repeated substrate alignment.

Even if the reference pins 100 are made of PEEK having a superior anti-wear property, as illustrated in FIG. 5, a part of the substrate support surface 121 that comes into contact with the substrate S may be worn out or come off so as to form a groove 121*a* after the repeated substrate alignment is performed.

In this embodiment, even after the groove 121*a* is formed on the part of the substrate support surface 121, the reference pin 100 may stably support the substrate S so as to maintain the alignment state of the substrate S.

As illustrated in FIG. 5, since the substrate support surface 121 includes the inversely inclined surface, the groove 121*a*, which may be formed on the part of the inversely inclined surface, is formed on an upper side of the inversely inclined surface, and the support pin 100 can support the one side of the substrate S, which enters into the groove 121*a*, simultaneously from the side surface and the upper portion of the substrate S so as to stably support the substrate S.

Hereinafter, the function and effect of the reference pin 100 according to this embodiment will be described in comparison to a cylindrical reference pin.

Figure 6:
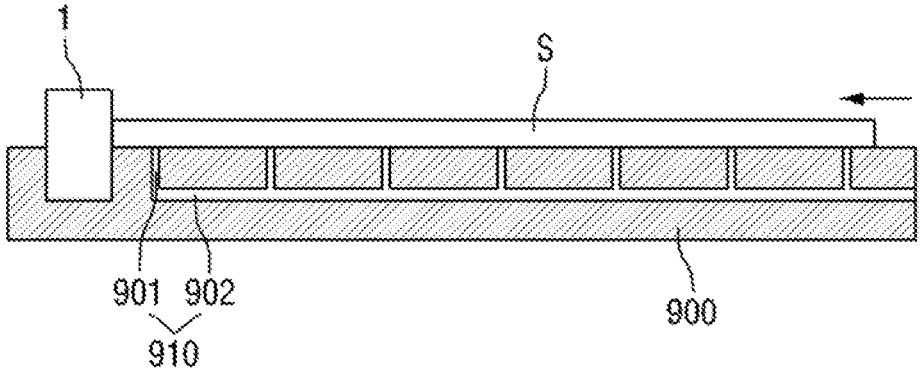
FIG. 6 is a view illustrating an apparatus for aligning a substrate, in which a cylindrical reference pin is installed.
Figure 7:
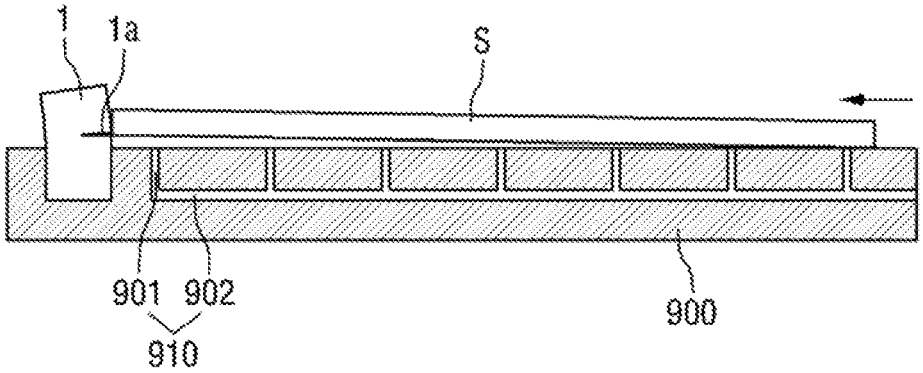
FIG. 7 is a view illustrating a substrate alignment state in the case where a cylindrical reference pin is cracked.
Figure 8:
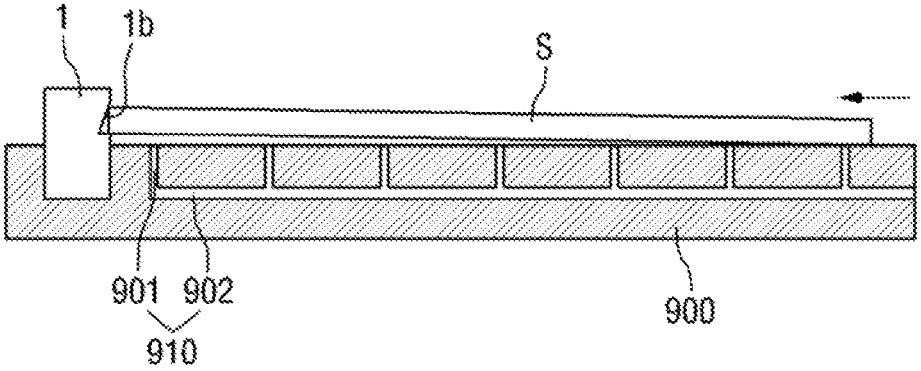
FIG. 8 is a view illustrating a substrate alignment state in the case where a cylindrical reference pin is grooved.

FIG. 6 is a view illustrating an apparatus for aligning a substrate in which a cylindrical reference pin is installed, FIG. 7 is a view illustrating a substrate alignment state in the case where a cylindrical reference pin is cracked, and FIG. 8 is a view illustrating a substrate alignment state in the case where a cylindrical reference pin is grooved.

As illustrated in FIG. 6, a cylindrical reference pin 1 is installed on an upper surface of the stage 900. The cylindrical reference pin 1 may also be provided so as to project from the upper surface of the stage 900 and may support the one side of the substrate S as a reference of the substrate alignment. Since the shape of the stage 900 and the seating/fixing method of the substrate S are similar to those described above, an explanation thereof will be omitted.

After the repeated substrate alignment, as illustrated in FIGS. 7 and 8, a part of the side surface of the cylindrical reference pin 1 may be worn out or come off, and thus the cylindrical reference pin 1 may be cracked or grooved.

The side surface of the cylindrical reference pin 1 is formed perpendicular to the stage 900 and comes into contact with the front surface of the one side of the substrate S. However, when the reference pin 1 supports the substrate S that is moving toward the reference pin 1, much more shearing force acts on the reference pin 1 as the boundary surface between the reference pin 1 and the stage 900 comes closer, and a crack 1*a* frequently occurs in the vicinity of the boundary surface between the reference pin 1 and the stage 900.

Accordingly, as illustrated in FIG. 7, if the crack 1*a* is formed in the vicinity of the boundary surface between the reference pin 1 and the stage 900, the substrate S may come up on the crack 1*a* as the substrate S moves toward the reference pin 1 by the push unit (not illustrated) in the process of aligning the substrate S. This phenomenon occurs more frequently as the thickness of the substrate S becomes smaller.

Particularly, if the crack 1*a* occurs so as to form a step height against the stage 900, as illustrated in FIG. 7, the substrate S comes up on the crack 1*a*, and thus one side of the substrate S is not in close contact with the stage 900, but is separated from the upper portion of the stage 900. In this state, the substrate S is not appropriately aligned, and even if the vacuum exhaust is performed through the suction holes 901, the vacuum pressure is not formed between the substrate S and the stage 900. Accordingly, the substrate S is not fixed to the stage 900, and this may cause bad influence to be exerted on the following process.

Furthermore, as illustrated in FIG. 8, a groove 1*b* may be formed on the reference pin 1. The groove 1*b* may be formed as a part of the side surface of the reference pin 100 comes off after the crack 1*a* as illustrated in FIG. 7 occurs, or the groove 1*b* may be formed due to repeated contact with the substrate S.

Even if the groove 1*b* is formed on the reference pin 1, that is, if the groove 1*b* is formed with the step height against the stage 900, or if an inclination is formed on a bottom surface of the groove 1*b*, the one side of the substrate S is not in close contact with the stage 900, but is separated from the upper portion of the stage 900.

Even in such circumstances, the one side of the substrate S is not in close contact with the stage 900, but is aligned in a state where it is separated from the upper portion of the stage 900, and the alignment and fixing of the substrate S is not normally performed.

Figure 9:
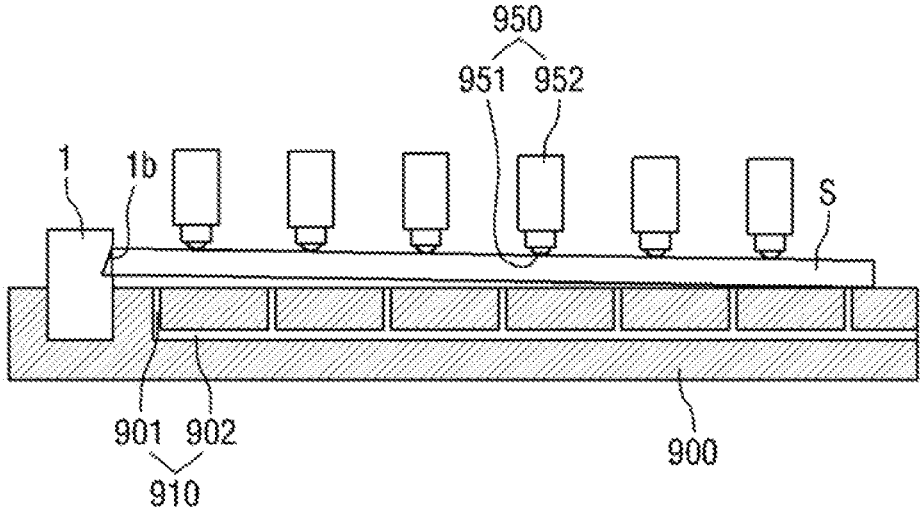
FIG. 9 is a view illustrating a substrate cutting process in the substrate alignment state of FIG. 8.

FIG. 9 is a view illustrating a substrate cutting process in the substrate alignment state of FIG. 8.

In the case where a process is performed with respect to the substrate S after the substrate alignment is performed in a state as illustrated in FIG. 7 or 8, a normal process is not performed. As a representative example, problems that occur in the substrate cutting process will be described.

Unit substrates are manufactured by cutting a large-area substrate S to a predetermined size. For this, in a cutting process, after the substrate S is aligned and fixed on the stage 900, a plurality of cutters 950 having cutting heads 952 and cutting knives 951 cut the substrate S while pressing the substrate S.

As illustrated in FIG. 9, in the case where the cutting heads 952 cut the substrate S in a state where the one side of the substrate S is not in close contact with the stage 900 but is separated from the stage 900 due to the groove 1*b* of the reference pin 1, the pressure for the cutting heads 952 to press the substrate S is not properly transferred to the substrate S, and this causes processing inferiorities, such as improper cutting of the substrate S or inclined cutting surfaces of the substrate S.

By contrast, according to this embodiment illustrated in FIGS. 1 and 2, the reference pin 100 includes the projection end 120 which is formed so that the upper end thereof projects further toward the substrate S than the lower end thereof, and the substrate support surface 121 which connects the upper end and the lower end of the projection end 120 and forms the inversely inclined surface. When the one side of the substrate S is supported, the upper end of the one side of the substrate S preferentially comes into contact with the substrate support surface 121.

Even if the crack or the groove is formed on the substrate support surface 121 due to the repeated substrate alignment, the crack or the groove is formed on the upper side of the substrate support surface 121, and as illustrated in FIG. 5, the upper end of the one side of the substrate S enters into the inside of the crack or the groove.

Accordingly, as illustrated in FIG. 7 or 8, since the lower end of the one side of the substrate S is prevented from being separated from the stage 900 due to the crack or the groove, and since the crack or the groove, which is formed on the upper side of the substrate support surface 121, supports the substrate S downwardly and/or on the side, the substrate S comes into further close contact with the stage 900.

Hereinafter, reference pins according to other embodiments of the present invention will be described. For convenience in explanation, explanation of the portions common to those according to the first embodiment will be omitted.

Figure 10:
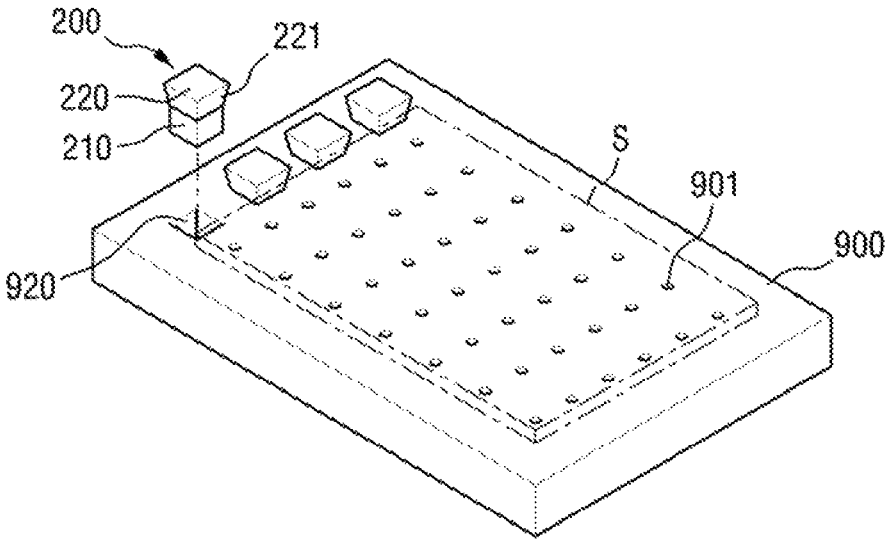
FIG. 10 is a perspective view illustrating reference pins according to a second embodiment of the present invention.

FIG. 10 is a perspective view illustrating reference pins according to a second embodiment of the present invention.

Whereas the reference pin 100 according to the first embodiment illustrated in FIG. 1 includes the projection end 120 having the shape of an inverse circular truncated cone, a reference pin 200 according to the second embodiment of the present invention as illustrated in FIG. 10 may include a projection end 220 having the shape of an inverse frustum of a quadrangular pyramid.

Due to the shape of the inverse frustum of a quadrangular pyramid, the projection end 220 of the reference pin 200 according to the second embodiment may be provided with a side surface of the projection end 220, an upper end portion of which is formed so as to project further toward the other side of the stage 900 than a lower end portion thereof.

Accordingly, if it is assumed that the surface which is directed to the other side of the stage 900, among side surfaces of the projection end 220 is a substrate support surface 221 as in the first embodiment, the substrate support surface 221 according to the second embodiment forms the inversely inclined surface, and when the substrate support surface 221 supports the one side of the substrate S, the upper end of the one side of the substrate S preferentially comes into contact with the substrate support surface 221.

In the case of the reference pin 100 according to the first embodiment, the substrate support surface 121 is a curved surface having an inversely inclined surface, and thus the substrate support surface 121 comes in point contact with the substrate S. However, according to the second embodiment, the substrate support surface 221 has a plane having the inversely inclined surface, and thus the substrate support surface 221 comes into line contact with the substrate S. Accordingly, the substrate S is supported more firmly with a wider contact area, and thus pressure that acts on the reference pin 200 is attenuated so as to prolong the terms of use of the reference pin 200.

Although FIG. 10 illustrates an insertion end 210 of the reference pin 200 that is in a rectangular prism shape, various shapes, such as cylinders, may be adopted so as to correspond to the shape of a reference pin installation groove 920 that is formed on the stage 900.

Figure 11:
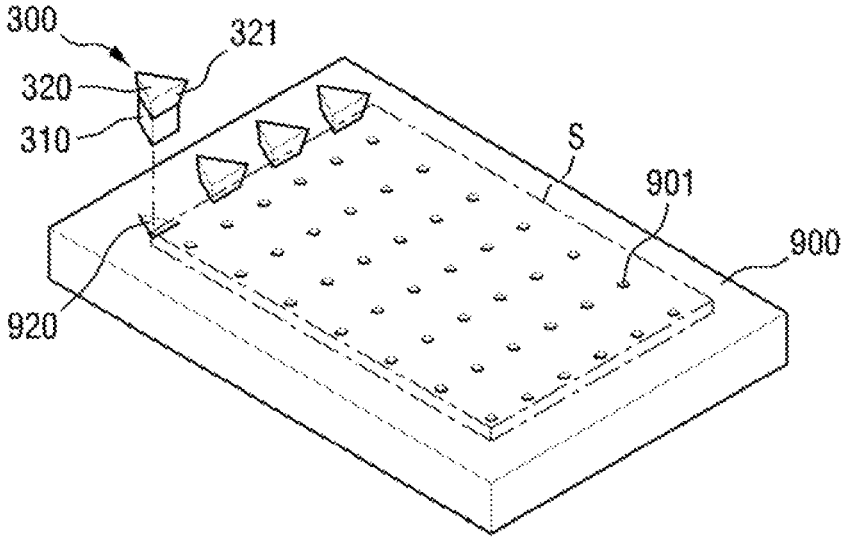
FIG. 11 is a perspective view illustrating reference pins according to a third embodiment of the present invention.

FIG. 11 is a perspective view illustrating reference pins according to a third embodiment of the present invention, In a reference pin 300 according to the third embodiment illustrated in FIG. 11, a projection end 320 has the shape of an inverse truncated prism as compared to the reference pin 200 according to the second embodiment.

Accordingly, the side surface of the projection end 320 of the reference pin 300 according to the third embodiment is formed so that an upper end portion thereof is formed so as to project further toward the other side of the stage 900 than a lower end portion thereof, and thus has a substrate support surface 321 that is inversely inclined.

When the projection end 320 supports the one side of the substrate S, the substrate support surface 321 that is inversely inclined preferentially comes in line contact with the upper end of the one side of the substrate S.

The reference pin according to the present invention may be provided with a projection end that includes various shapes of inverse frustum of a pyramid which comes in line contact with the upper end of the one side of the substrate S and supports the substrate S, in addition to the reference pins 200 and 300 according to the second and third embodiments.

Figure 12:
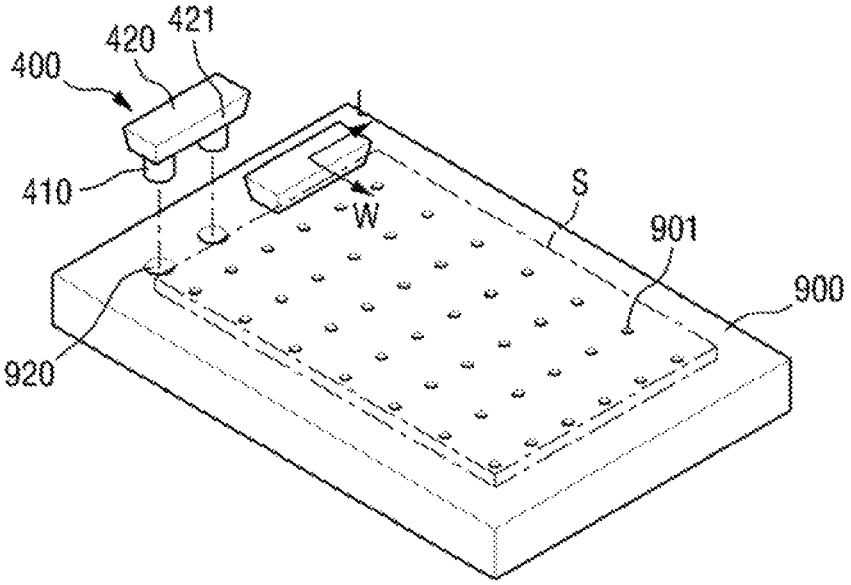
FIG. 12 is a perspective view illustrating reference pins according to a fourth embodiment of the present invention.

FIG. 12 is a perspective view illustrating reference pins according to a fourth embodiment of the present invention.

In comparison to the reference pin 200 according to the second embodiment illustrated in FIG. 10, a reference pin 400 according to the fourth embodiment illustrated in FIG. 12 includes a bar-shaped projection end 420 that is formed somewhat long along the one side of the substrate S. That is, if it is assumed that the direction in which a main support force is applied to the substrate S is a width direction (W-axis) of the projection end 420, and a direction that is in parallel to the one side surface of the substrate S is a length direction (L-axis) of the projection end 420, the length of the projection end 420 may be formed longer than the width thereof.

Even in this embodiment, the projection end 420 is formed so as to include the shape of the inverse frustum of a pyramid, and the substrate support surface 421 is inversely inclined.

In order for the bar-shaped projection end 420 to stably support the one side of the substrate S, the projection end 420 according to this embodiment may be formed with a length that corresponds to at least two reference pin installation grooves 421 formed on the stage 900. That is, on the lower portion of one projection end 420, two or more insertion ends 410 that correspond to the respective reference pin installation grooves 920 may be formed.

Furthermore, although FIG. 12 illustrates that a plurality of reference pins 400, in which two insertion ends 410 are formed on the lower portion of one projection end 420, are provided, the reference pin 400 according to this embodiment may be formed so as to support the entirety of one side of the substrate S.

Figure 13:
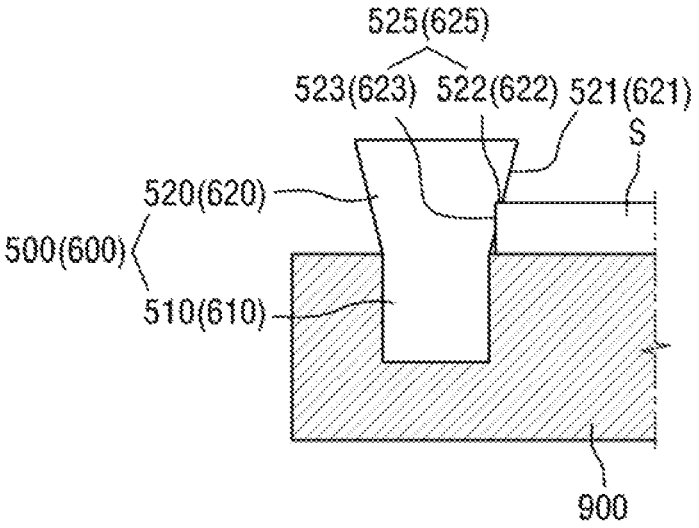
FIG. 13 is a side view illustrating a reference pin according to fifth and sixth embodiments of the present invention.
Figure 14:
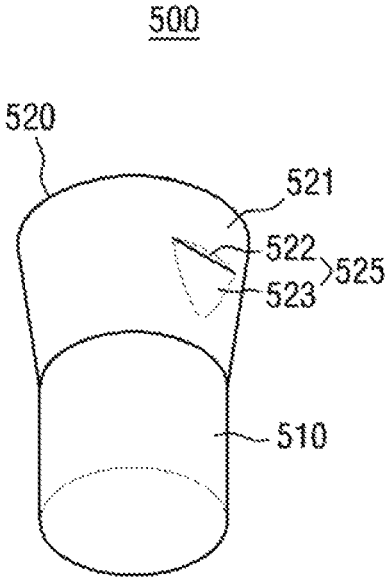
FIG. 14 is a perspective view illustrating a reference pin according to the fifth embodiment of the present invention.

FIG. 13 is a side view illustrating a reference pin according to fifth and sixth embodiments of the present invention, and FIG. 14 is a perspective view illustrating a reference pin according to the fifth embodiment of the present invention.

A reference pin 500 according to the fifth embodiment illustrated in FIGS. 13 and 14 further includes a support end 525, a substrate support surface 521 of which is recessively formed inside the projection end 520 in comparison to the reference pin 100 according to the first embodiment illustrated in FIG. 1.

The support end 525 may be provided with an upper support surface 522 and a side support surface 523 which are substantially perpendicular to each other.

The upper support surface 522 may be formed so as to correspond substantially to the height of the substrate S, may be formed parallel to the stage 900 or the substrate S, and may come into contact with the upper surface of the one side of the substrate S that is supported by the projection end 520.

The side support portion 523 may be formed so as to come into contact with the upper support surface 522 so as to be substantially perpendicular to the upper support surface 522, and may come into surface contact with the side surface of the one side of the substrate S.

In the case of the reference pin 100 according to the first embodiment, the substrate support surface 121 is a curved surface having an inversely inclined surface, and thus the substrate support surface 121 comes into point contact with the substrate S. According to the second embodiment, the substrate support surface 221 has a plane having an inversely inclined surface, and thus the substrate support surface 221 comes into line contact with the substrate S. However, with respect to the reference pin 500 according to this embodiment, the support end 525 is provided on the substrate support surface 521, and the support end 525 comes into surface contact with the side surface of the one side of the substrate S so as to support the substrate S.

Accordingly, in comparison to the reference pins 100 and 200 according to the first and second embodiments, since the substrate S is supported more firmly and the contact area becomes wider, the pressure that acts on the reference pin 500 is attenuated, and thus the terms of use of the reference pin 500 can be prolonged.

As illustrated in FIGS. 13 and 14, the support end 525 according to this embodiment may be formed in the center portion of the substrate support surface 521, and may not come into contact with the lower end of the side surface of the one side of the substrate S. This is to prevent the crack or the groove from occurring in the lower end portion of the substrate support surface 521.

On the other hand, although not illustrated, the support end 525 may be formed so that the side support surface 523 extends up to the lower end of the substrate support surface 521. In this case, the side support surface 523 supports even the lower end of the side surface of the one side of the substrate, and the crack or the groove may occur in the lower end portion of the substrate support surface 521. However, since the upper support surface 522 of the support end 525 supports the upper surface of the one side of the substrate S, the substrate S is prevented from being separated from the stage 900 due to the crack or the groove that is formed on the lower end portion.

Figure 15:
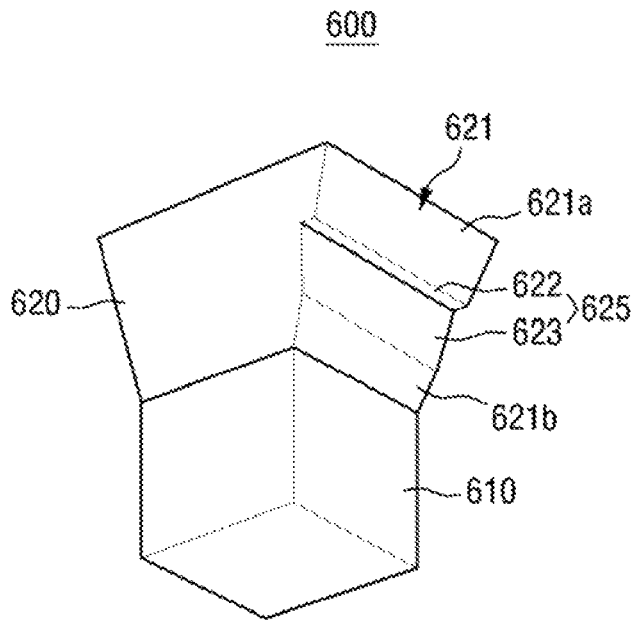
FIG. 15 is a perspective view illustrating a reference pin according to the sixth embodiment of the present invention.

FIG. 15 is a perspective view illustrating a reference pin according to the sixth embodiment of the present invention.

In comparison to the reference pin 500 according to the fifth embodiment illustrated in FIG. 14, a reference pin 600 according to the sixth embodiment illustrated in FIG. 15 includes a projection end 620 having the shape of an inverse frustum of a quadrangular pyramid.

As illustrated in FIG. 15, the substrate support surface 621 of the reference pin 600 according to this embodiment includes a first inversely inclined surface 621*a* that is formed so as to extend from the upper end of the substrate support surface 621 to a lower side, a second inversely inclined surface 621*b* that is formed so as to extend from the lower end of the substrate support surface 621 to an upper side, and a support end 625 formed between the first inversely inclined surface 621*a* and the second inversely inclined surface 621*b*, and recessively formed inside the projection end 620.

Unlike the reference pin 500 according to the fifth embodiment as described above, the substrate support surface 621 of the reference pin 600 according to this embodiment forms a plane, and thus the inversely inclined surface is separated upward/downward by the support end 625 so as to be divided into the first inversely inclined surface 621*a* and the second inversely inclined surface 621*b*.

In a similar manner to the fifth embodiment as described above, the support end 625 according to this embodiment is also provided with an upper support surface 622 and a side support surface 623 which are substantially perpendicular to each other. The upper support surface 622 may be formed so as to correspond substantially to the height of the substrate S and so as to come into contact with the upper surface of the one side of the substrate S, and the side support surface may come in surface contact with the side surface of the one side of the substrate S.

As illustrated in FIGS. 13 and 15, the reference pin 600 according to this embodiment is formed so that the second inversely inclined surface 621*b* is provided on the lower portion of the support end 625, and the side support surface 623 may be formed so as not to come into contact with the lower end of the side surface of the one side of the substrate S. This is to prevent a crack or a groove from occurring in the lower end portion of the substrate support surface 621.

On the other hand, although not illustrated, the reference pin 600 according to this embodiment may be formed so that the side support surface 623 extends up to the lower end of the substrate support surface 621. In this case, the side support surface 623 supports even the lower end of the side surface of the one side of the substrate, and thus the crack or the groove may occur on the lower end portion of the substrate support surface 621. However, since the upper support surface 622 of the support terminal 625 supports the upper surface of the one side of the substrate S, the substrate S is prevented from being separated from the stage 900 due to the crack or the groove occurring in the lower end portion.

Although FIG. 15 illustrates that the projection end 620 of the reference pin 600 according to an embodiment includes the shape of the inverse frustum of a quadrangular pyramid, the projection end 620 that includes various shapes of inverse frustum of a pyramid may be configured.

Furthermore, the support end 625, which is one of features according to this embodiment, can be applied even to the bar-type reference pin 100 according to the fourth embodiment as described above.

Figure 16:
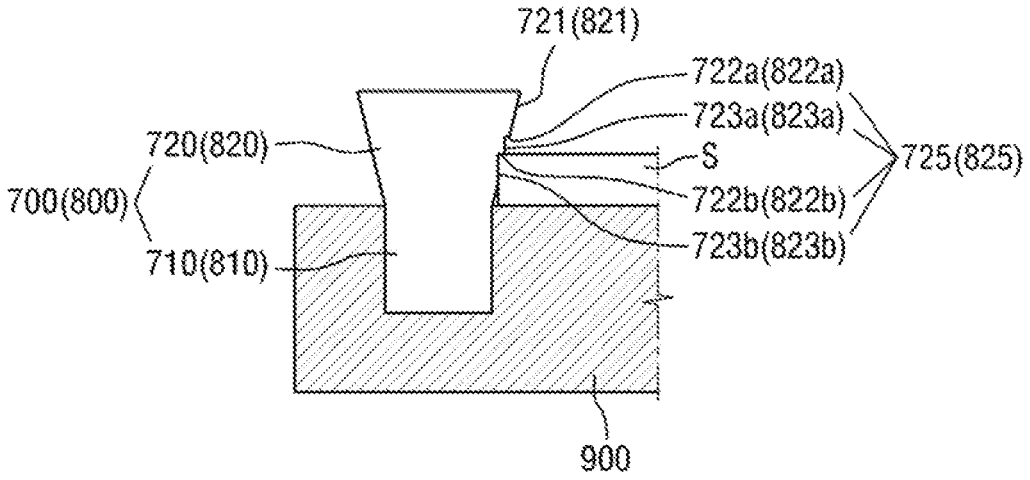
FIG. 16 is a side view illustrating a reference pin according to seventh and eighth embodiments of the present invention.
Figure 17:
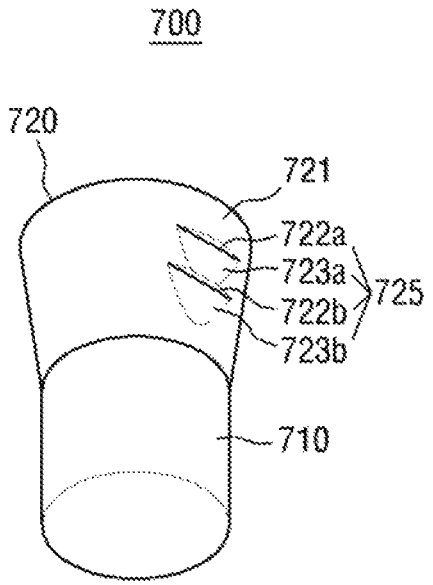
FIG. 17 is a perspective view illustrating a reference pin according to the seventh embodiment of the present invention.

FIG. 16 is a side view illustrating a reference pin according to seventh and eighth embodiments of the present invention, and FIG. 17 is a perspective view illustrating a reference pin according to the seventh embodiment of the present invention.

A reference pin 700 according to the seventh embodiment illustrated in FIGS. 16 and 17 may be formed so that the support end 725 is in a step-style structure as compared with the reference pin 500 according to the fifth embodiment illustrated in FIGS. 13 and 14.

The support end 725 may include a first upper support surface 722*a* and a first side support surface 723*a* which are formed substantially perpendicular to each other, and a second upper support surface 722*b* and a second side support surface 723*b* which are formed substantially perpendicular to each other.

The first upper support surface 722*a* may be recessively formed inside the projection unit 720 in parallel with the stage 900 or the substrate S at a predetermined height of the substrate support surface 721, and the first side support surface 723*a* may be formed so as to come into contact with the first upper support surface 722*a* and to be substantially perpendicular to the first upper support surface 722*a*.

The second upper support surface 722*b* may be recessively formed inside the projection end 720 substantially parallel to the first upper support surface 722*a* so as to be adjacent to the lower end of the first side support surface 723*a*, and the second side support surface 723*b* may be formed so as to come into contact with the second upper support surface 722*b* so as to be substantially perpendicular to the first upper support surface 722*b*.

Although not illustrated, the support end 725 may be provided with an additional upper support surface and side support surface on the lower portion of the second side support surface 723*b*.

That is, the reference pin 700 according to this embodiment may be provided with a support end 725 of a multistage step-style structure that projects with a step height toward the substrate S as the support end 725 extends to the upper side of the substrate support surface 721.

In comparison to the reference pin according to the above-described embodiments, the reference pin 700 according to this embodiment is provided with the support end 725 of the multistage step-style structure, and thus even the substrate S having various heights can be stably aligned.

That is, with respect to the substrate S having a relatively low height, the second side support portion 723*b* may maintain and support the surface contact with the side portion of the one side of the substrate S, and with respect to the substrate S having a relatively high height, the first side support surface 723*a* that is positioned on the upper side compared to the second side support surface 723*b* may maintain and support surface contact with the side portion of the one side of the substrate S.

The reference pin 700 according to this embodiment may be formed so that the support unit 725 is provided in the center portion of the substrate support surface 721, and the first side support surface 723*a* and the second side support surface 723*b* do not come into contact with the lower end of the side surface of the one side of the substrate S. This is to prevent a crack or a groove from being generated in the lower end portion of the substrate support surface 721.

Furthermore, although not illustrated, the second side support surface 723*b* may be formed so as to extend up to the lower end of the substrate support surface 721. In this case, the second side support surface 723*b* supports up to the lower end of the side surface of the one side of the substrate S, and a crack or a groove may be produced on the lower end portion of the substrate support surface 721. However, since the first upper support surface 722*a* or the second upper support surface 722*b* supports the upper surface of the one side of the substrate S, the substrate S is prevented from being separated from the stage 900 due to the crack or the groove produced on the lower end portion.

Figure 18:
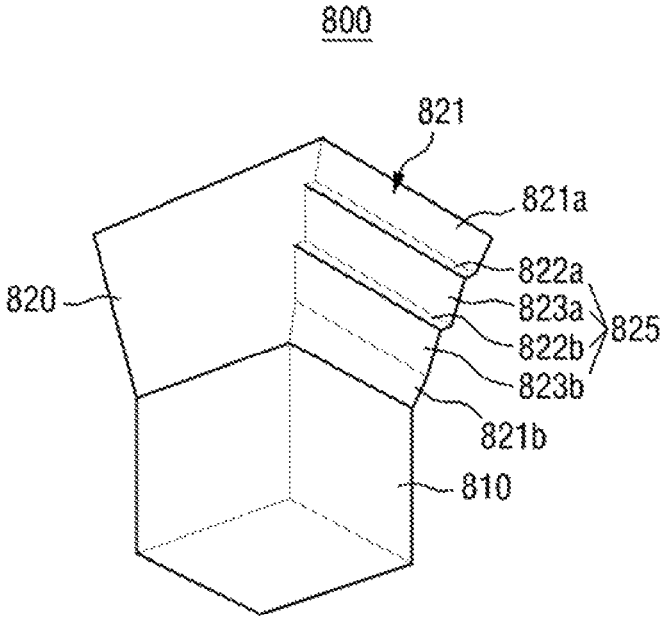
FIG. 18 is a perspective view illustrating a reference pin according to the eighth embodiment of the present invention.

FIG. 18 is a perspective view illustrating a reference pin according to the eighth embodiment of the present invention.

In comparison to the reference pin 700 according to the seventh embodiment illustrated in FIG. 17, a reference pin 800 according to the eighth embodiment illustrated in FIG. 18 includes a projection end 820 having the shape of an inverse frustum of a quadrangular pyramid.

As illustrated in FIG. 18, the substrate support surface 821 of the reference pin 800 according to this embodiment includes a first inversely inclined surface 821*a* that is formed so as to extend from the upper end of the substrate support surface 821 to a lower side, a second inversely inclined surface 821*b* that is formed so as to extend from the lower end of the substrate support surface 821 to an upper side, and a support end 825 formed between the first inversely inclined surface 821*a* and the second inversely inclined surface 821*b* and recessively formed inside the projection end 820.

Unlike the reference pin 700 according to the seventh embodiment as described above, the substrate support surface 821 of the reference pin 800 according to this embodiment forms a plane, and thus the inversely inclined surface is separated upward/downward by the support end 825 so as to be divided into the first inversely inclined surface 821*a* and the second inversely inclined surface 821*b*.

In a similar manner to the seventh embodiment as described above, the support end 825 according to this embodiment may be provided with a first upper support surface 822*a* and a first side support surface 823*a* which are formed substantially perpendicular to each other, and a second upper support surface 822*b* and a second side support surface 823*b* which are formed substantially perpendicular to each other.

Since the additional explanation of the support end 825 is the same as that according to the seventh embodiment as described above, the explanation thereof will be omitted.

Although FIG. 18 illustrates that the projection end 820 of the reference pin 800 according to an embodiment includes the shape of the inverse frustum of a quadrangular pyramid, the projection end 820 that includes various shapes of inverse frustum of a pyramid may be configured. Furthermore, the multistage support end 825, which is one of features according to this embodiment, can be applied even to the bar-type reference pin 400 according to the fourth embodiment as described above.

Figure 19:
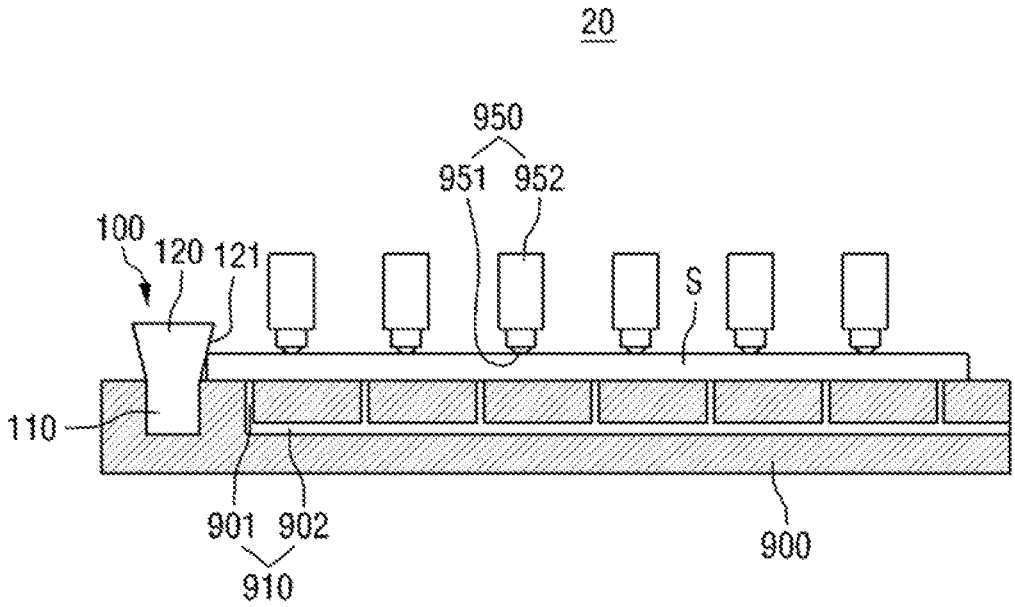
FIG. 19 is a view schematically illustrating an apparatus for cutting a substrate according to an embodiment of the present invention.

Hereinafter, an apparatus for cutting a substrate to which the apparatus for aligning a substrate as described above is applied will be described. FIG. 19 is a view schematically illustrating an apparatus for cutting a substrate according to an embodiment of the present invention.

As illustrated in FIG. 19, an apparatus 20 for cutting a substrate according to an embodiment of the present invention includes a stage 900, reference pins 100, and cutting portion 950.

For convenience in explanation, although FIG. 19 illustrates the reference pins 100 and the stage 900 according to the first embodiment as described above, the reference pins 200-800 and the stage 900 according to the second to eighth embodiments as described above also can be applied, and since the explanation of the respective embodiments is the same as the explanation of the reference pins 100-800 and the stage 900 according to the first to eighth embodiments, the detailed description thereof will be omitted.

The cutting portion 950 may be provided on the upper portion of the stage 900, and may include cutting heads 952 having cutting knives 951 on the lower end thereof.

As illustrated in FIG. 19, the cutting portion 950 may be provided with the plurality of cutting heads 952, and the plurality of cutting heads 952 may be provided at predetermined intervals so as to correspond to the area of the substrate S that is the target of cutting.

The substrate S is cut in horizontal and/or vertical directions by the cutting heads 952 so as to be separated into unit substrates.

In the case of two directional (horizontal and vertical) cutting, the cutting portion 950 may be configured so as to cut the substrate S while horizontally moving the plurality of cutting heads 952 provided in a line in the vertical direction, to horizontally rearrange the plurality of cutting heads 952 in a line, to vertically move the cutting heads 952, and then to secondarily cut the substrate S (the order of the cutting directions may be changed). The cutting portion 950 may also be configured to separately provide a plurality of cutting heads 952 vertically provided in a line and a plurality of cutting heads 952 horizontally provided in a line, and to successively cut the substrate S by directions.

The cutting knife 951 may be a wheel having higher hardness than the substrate S (e.g., diamond wheel) or a nozzle that sprays high-pressure fluid.

As illustrated in FIGS. 3 and 4, the substrate S may be loaded onto the stage 900, move to the side of the reference pins 100, and then be aligned on the stage 900. At this time, the one side of the substrate S comes into contact with the substrate support surfaces 121 of the reference pins 100 and is supported by the reference pins 100.

As described above, since the substrate support surfaces 121 of the reference pins 100 are provided with inversely inclined surfaces and/or the support ends to support the upper end portion of the one side of the substrate S, the reference pins 100 support the substrate S by pressing the substrate S downwardly and/or on the side. Accordingly, the substrate S is prevented from being separated from the stage 900, and comes into close contact with the stage 900 so as to be fixed to the stage 900.

After the substrate S is supported by the reference pins 100 and is seated in the alignment position, the vacuum exhaust process may be performed through the suction holes 901 and the suction flow paths 902 which are provided in the stage 900. In this way, vacuum pressure is formed between the substrate S and the stage 900, and thus the substrate S is fixed to the stage 900.

Thereafter, the cutting portion 950 makes the cutting knives 951 come into close contact with the upper surface of the substrate S after being positioned on the upper portion of the substrate S, and cuts the substrate S in horizontal and/or vertical directions.

Since the front surface of the substrate S comes stably into close contact with the stage 900 by the reference pins 100 provided with the inversely inclined surface and/or the support end, the predetermined pressure which the cutting knives 951 apply to the substrate S is fully transferred to the substrate S in the substrate cutting process, and thus the substrate cutting can be performed accurately and stably.

Although preferred embodiments of the present invention have been described for illustrative purposes, those skilled in the art will appreciate that various modifications, additions and substitutions are possible without departing from the scope and spirit of the invention as disclosed in the accompanying claims.

What is claimed is:

1. A method for cutting a substrate, comprising: preparing a stage having a rectangular shape with four edges, the stage having a row of reference pin installation grooves positioned adjacent solely and exclusively to one entire edge of the four edges of the stage and a plurality of suction holes uniformly distributed in rows and columns adjacent to the row of reference pin installation grooves, and reference pins inserted into the row of reference pin installation grooves and partially projecting from an upper surface of the stage;

loading a substrate on the stage;

pushing the substrate toward the reference pins such that only an upper end of one side of the substrate is supported at one side of each of the reference pins to align the substrate on the stage;

forming a vacuum pressure between the stage and the substrate to fix the substrate to the stage; and cutting the fixed substrate by using a cutting portion provided on an upper portion of the stage, wherein said each reference pin includes a projection end which is formed to extend from at least two insertion ends and project from the upper surface of the stage, wherein said each projection end supports one side of the substrate, and an upper end of said each reference pin is formed to project further toward the substrate than a lower end of said each respective projection end, and wherein a longitudinal length of said each projection end is at least a distance between adjacent reference pin installation grooves, and the at least two insertion ends are formed on a lower portion of said each projection end, wherein the at least two insertion ends are inserted into the reference pin installation grooves.

2. The method for cutting a substrate of claim 1, wherein said each reference pin includes an inversely inclined surface which connects the upper end and the lower end of said each reference pin and which supports the substrate.

3. The method for cutting a substrate of claim 2, wherein:

said each inversely inclined surface includes a support end having an upper support surface and a side support surface intersecting the upper support surface;

said each upper support surface has a same height as a height of the substrate, and is configured to surface contact with at least a portion of one upper surface of the substrate; and said each side support surface is configured to surface contact with at least a portion of one side surface of the substrate.

4. The method for cutting a substrate of claim 1, wherein an acute angle that is formed between the inversely inclined surface and the stage is not less than 85 degrees.

5. The method for cutting a substrate of claim 1, wherein said each reference pin includes an inversely inclined surface that is formed so as to extend from the upper end of said each reference pin to a lower side of a substrate support surface, and a support end recessively formed from the lower end of the inversely inclined surface to an inside direction of said each reference pin so as to directly contact the substrate.

6. The method for cutting a substrate of claim 5, wherein said each support end has a step-style structure that projects with a step height toward the substrate as said each support end extends to the upper side of said each substrate support surface.

7. The method for cutting a substrate of claim 1, wherein said each reference pin includes a first inversely inclined surface that is formed so as to extend from the upper end of said each reference pin to a lower side of a substrate support surface, a second inversely inclined surface that is formed so as to extend from the lower end of said each substrate support surface to an upper side of said each substrate support surface, and a support end formed between said each first inversely inclined surface and said each second inversely inclined surface and recessively formed in an inside direction of said each reference pin so as to support one side of the substrate.

8. The method for cutting a substrate of claim 7, wherein said each support end has a step-style structure that projects with a step height toward the substrate as said each support end extends to the upper side of said each substrate support surface.

9. The method for cutting a substrate of claim 1, wherein said each reference pin has a step-style structure that projects with a step height toward the substrate as said each reference pin extends from the lower end of said each reference pin to the upper end of said each reference pin.

* * * * *